United States Patent [19]

Hubbard et al.

[11] 4,225,163

[45] Sep. 30, 1980

[54] PANIC DEVICE ACTUATOR

[75] Inventors: S. Eugene Hubbard, Niles; Richard A. Meisterheim, Dowagiac, both of Mich.

[73] Assignee: Kawneer Company, Inc., Niles, Mich.

[21] Appl. No.: 938,924

[22] Filed: Sep. 1, 1978

[51] Int. Cl.[2] ..... E05C 9/10; E05C 15/02

[52] U.S. Cl. ..... 292/21; 292/34; 292/37; 292/92

[58] Field of Search ..... 292/34, 35, 36, 37, 292/41, 53, 166, 168, 21, 92, 93; 70/92, 120

[56] References Cited

U.S. PATENT DOCUMENTS

| | | | |
|---|---|---|---|
| 1,039,734 | 10/1912 | Hannum et al. | 292/21 |
| 1,670,277 | 5/1928 | Albach | 292/37 X |
| 2,755,519 | 7/1956 | Xander | 292/35 X |
| 3,024,053 | 3/1962 | Cox et al. | 292/21 |
| 3,614,145 | 10/1971 | Zawadzki | 70/92 X |
| 3,663,047 | 5/1972 | Zawadzki | 292/21 X |
| 3,767,238 | 10/1973 | Zawadzki | 292/21 |
| 4,009,537 | 3/1977 | Hubbard | 292/21 X |
| 4,083,590 | 4/1978 | Folger | 292/21 X |
| 4,130,306 | 12/1978 | Brkic | 292/21 X |

FOREIGN PATENT DOCUMENTS

| | | | |
|---|---|---|---|
| 2444628 | 4/1975 | Fed. Rep. of Germany | 292/92 |
| 18871 | of 1892 | United Kingdom | 292/92 |
| 383359 | 11/1932 | United Kingdom | 292/53 |
| 425263 | 3/1935 | United Kingdom | 292/37 |

*Primary Examiner*—Thomas J. Holko

*Attorney, Agent, or Firm*—Mason, Kolehmainen, Rathburn & Wyss

[57] ABSTRACT

A panic device actuator for a door includes apparatus for unlatching a door mounted in a door frame and which includes one or more elements movable for retracting one or more door latches normally engaged with the door frame for positively locking the door. The panic actuator includes a relatively large panel having an enlarged outer face responsive to pressure applied at any area thereon for unlocking the door without a key. A mounting system is provided for supporting the panel on the door for controlled movement in a horizontal direction in continuous parallelism with the face of the door in a direction normal to the door face. A linkage is provided for interconnecting the panel and the door latching element(s) for moving the same to unlock the door latches in response to pressure movement of the panel on the door. The novel panic actuator is designed so that pressure applied at any point on the outer face of the panel results in movement of the panel as a whole in precise parallelism with the door face without wedging or binding and a standard size panel may be used with doors of different widths.

30 Claims, 18 Drawing Figures

FIG. 14
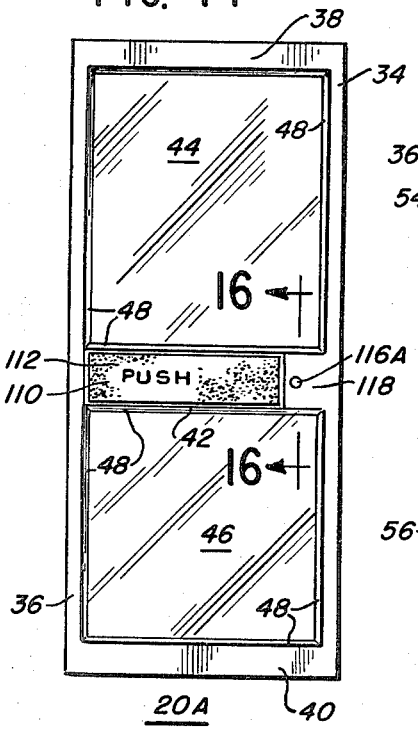
FIG. 15
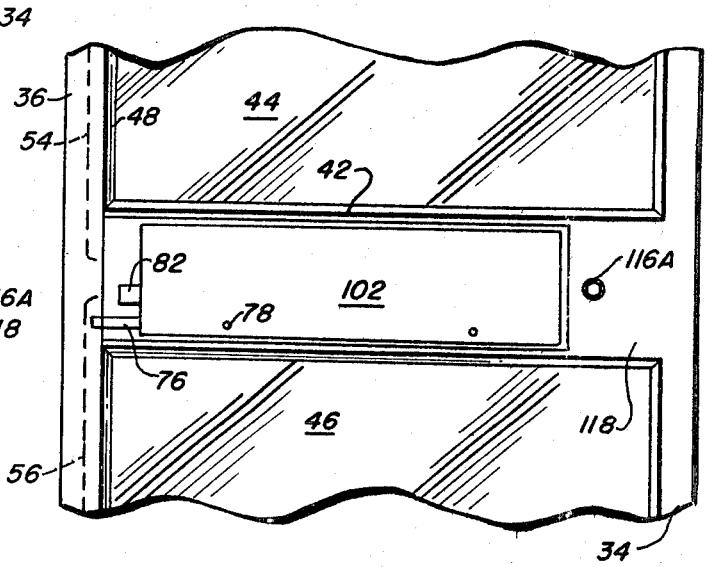
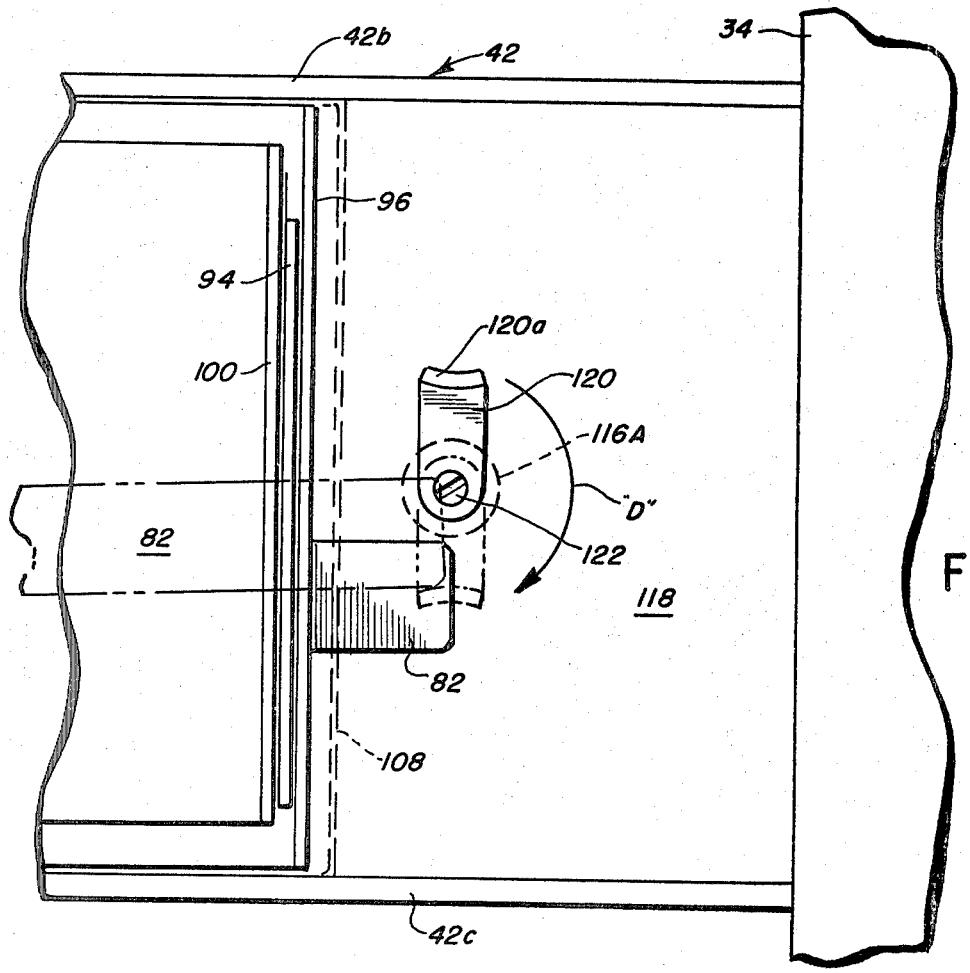
FIG. 17

PANIC DEVICE ACTUATOR

BACKGROUND OF THE INVENTION

1. Field of the Invention

The present invention relates to a new and improved actuator for a panic device on a door and more particularly to a new and improved panic device actuator useful for unlocking an exit door which is normally latched to a door frame. Unlatching and opening of the door without a key is achieved by the application of force on a panel on the door from inside of a building.

2. Description of the Prior Art

A variety of panic exit doors and emergency escape systems have been provided to meet the safety needs of buildings and structures open to public access. Many safety code requirements provide that people inside a building must be afforded a system for getting out of a normally bolted or locked exit door without a key in case of a panic situation such as a fire or the like. Commonly available panic devices employ a bar extended across the door and spaced away from the adjacent door surface, thus affording an opportunity for an easy way of disabling the device. In many prior art installations, panic devices are often permanently or temporarily disabled from performing in the desired manner. Because of the inherent insecurity of presently available panic devices, ready ingress into the building by unauthorized outsiders is sometimes easy. Many door entrances including panic exit doors have panic devices that are unsightly in appearance and look like a hang-on or add-on device attached to the door as an afterthought. These devices are sometimes clearly visible from outside the building and provide an invitation to thieves and other unauthorized persons by offering a relatively easy way of fully entering the building.

OBJECTS OF THE INVENTION

It is an object of the present invention to provide a new and improved actuator for a panic device on a door which incorporates many advantageous features in comparison to prior art panic devices.

Another object of the present invention is to provide a new and improved panic actuator for a door wherein an unlocking system is physically incorporated into the door and is not readily noticeable from outside of the building.

Another object of the present invention is to provide a new and improved panic actuator of the character described, the existence of which is not readily discernible from the outside of a building even though the associated door is of the type employing one or more relatively large transparent panels.

Yet another object of the present invention is to provide a new and improved panic actuator wherein the panic unlocking apparatus is clearly visible from the inside of the building by the occupants but is not readily discernible from the outside of the building.

Yet another object of the present invention is to provide a new and improved panic actuator wherein a relatively large panel is provided which extends for a substantial portion of the distance between the opposite edges of the door at a level convenient for ready activation in response to pressure on the panel.

Yet another object of the present invention is to provide a new and improved panic actuator which may be dogged with a key from inside of the building in a way rendering the entire mechanism inoperative so as to permit free swinging use of the door during normal business or free access hours.

Another object of the present invention is to provide a new and improved panic actuator of the character described which may be locked and unlocked with a key from outside of the building as required.

Yet another object of the present invention is to provide a new and improved panic actuator of the character described which utilizes a panic unlocking system almost completely hidden from casual observance on one side of a door with transparent panels.

Still another object of the present invention is to provide a new and improved panic actuator of the character described wherein an actuator panel of relatively large cross-sectional area is provided for activation to unlock a normally latched door.

Still another object of the present invention is to provide a new and improved panel type, standard size panic actuator of the character described which is adapted to be used with doors of different sizes.

Still another object of the present invention is to provide a new and improved panic actuator capable of a large number of repeated operating cycles without failure.

Another object of the present invention is to provide a new and improved panic actuator having a relatively wide actuator panel which is pressure activated to move concealed elements for unlocking the door.

Yet another object of the present invention is to provide a new and improved panic actuator system which cannot be inactivated or rendered inoperative by methods such as pad-locking or blocking.

Yet another object of the present invention is to provide a new and improved panic exit door which results in increased building security and one that is not circumvented by the use of trip wires and the like of the type which are commonly used to bypass existing panic systems.

Yet another object of the present invention is to provide a new and improved panic actuator having increased strength and one without a bar actuator spaced from the adjacent door surface such as conventional "U-bar".

Still another object of the present invention is to provide a new and improved panic actuator system which will fit doors mounted for either a left or a right hand swing.

Yet another object of the present invention is to provide a new and improved panic actuator system which is adapted for use with a single door or with a pair of doors in an entrance.

Yet another object of the present invention is to provide a new and improved panic actuator which is neat in appearance, secure, economical to construct and install and which is extremely reliable in operation and which requires little in the way of periodic maintenance and servicing.

Still another object of the present invention is to provide a new and improved modular actuator suitable for use with doors of several various different types.

BRIEF SUMMARY OF THE INVENTION

In accordance with the features of the present invention, a new and improved panic actuator system is provided for a door mounted in a door frame and includes a latch retracting element(s) movable for unlatching one or more latching mechanisms normally engaged to lock the door with respect to the frame. The panic actuator in accordance with the invention includes a relatively large actuator panel having an enlarged outer face adapted for movement in response to pressure engagement for unlocking the door. Mounting means is provided for supporting the panel on the door for movement in a horizontal direction normal to the door face with the panel face in continuous parallelism with the face of the door. Linkage is provided for interconnecting the panel and a latch actuating element for moving the same in response to pressure applied at any point on the surface of the actuator panel on the door. The panel is relatively large in area and extends across a substantial portion of the width of the door between the edges. Pressure applied at any area on the panel is effective to unlock the door latch mechanism(s) and a key operated lock out system is provided for dogging the panic actuator from inside the building so that the door may be used to swing freely in response to normal traffic into and out of the building when desired. In addition, a key operated lock is provided so that the door may be locked and unlocked from outside the building with a key to control building security.

Outward pressure on the panel from inside the building will cause latches mounted adjacent an edge(s) of the door to be retracted from engaged or locked position with the door frame and thus permit the door to swing open rapidly so that persons who would otherwise be trapped within the building may rapidly exit via the building entrance. The novel panic actuator is not readily identifiable as a panic type installation from outside of the building even though the door itself may contain large glass panels and accordingly, a thief or unauthorized person may not be tempted to try and disable the panic system to gain unlawful entrance as is the case with prior or conventional panic systems which are visible. In addition, the novel panic exit door provides no convenient means whereby the panic safety system afforded thereby can be inactivated by pad-locking or blocking as commonly occurs with more conventional, exposed "U-bar" type panic actuators. In conventionally available panic systems, an actuating bar or rod is customarily spaced away from the adjacent inside door surface and this affords an opportunity for a trip wire inserted between the door edges to be hooked around the bar and pulled downwardly with sufficient force to unlatch the door. The panic actuator of the present invention affords no such opportunity for trip wires and the like to be used in this manner.

BRIEF DESCRIPTION OF THE DRAWINGS

For a better understanding of the invention, reference should be had to the following detailed description taken in conjunction with the drawings in which:

FIG. 14 is an inside elevational view of another embodiment of a new and improved panic exit door constructed in accordance with the features of the present invention;

FIG. 15 is an enlarged fragmentary, vertical, sectional view of the mid level rail portion of the door of FIG. 14;

FIG. 17 is an enlarged fragmentary cross-sectional view taken substantially along lines 17—17 of FIG. 16.

DESCRIPTION OF THE PREFERRED EMBODIMENT

Figure 2:
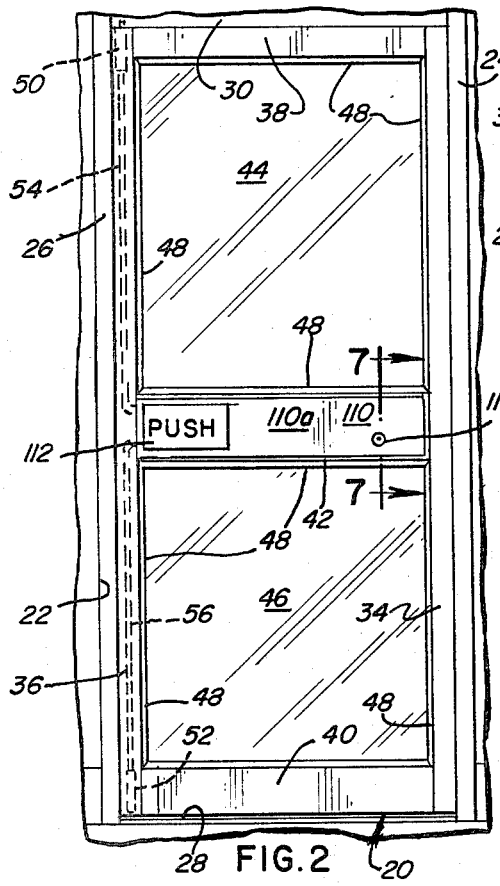
FIG. 2 is an inside elevational view of the panic exit door of FIG. 1.
Figure 1:
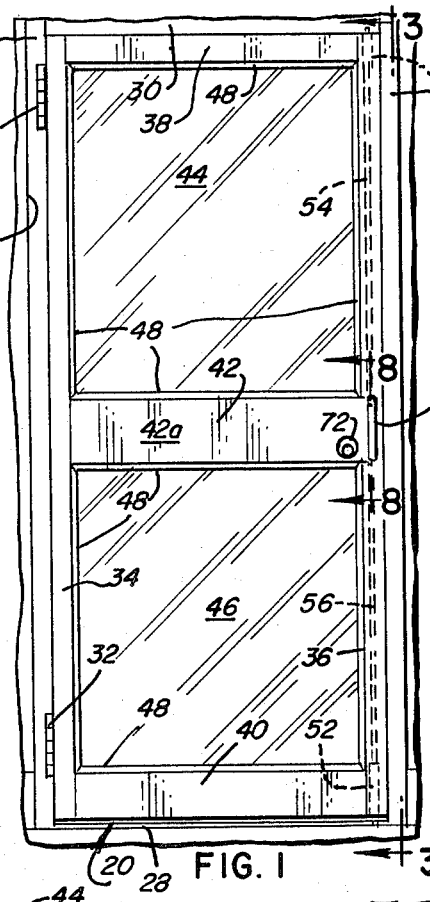
FIG. 1 is an elevational view of a new and improved panic exit door constructed in accordance with the features of the present invention as it appears from outside a building entrance.
Figure 3:
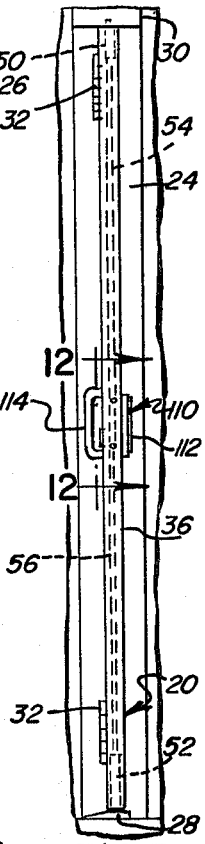
FIG. 3 is a transverse cross-sectional view taken substantially along lines 3—3 of FIG. 1.

Referring now more particularly to the drawings, therein is illustrated a new and improved panic actuator system constructed in accordance with the features of the present invention and illustrated generally in FIGS. 1, 2 and 3. A door 20 is especially adapted for use in an entrance opening 22 of a commercial building or a publicly accessible building where there is a safety requirement for providing a means for the people inside of the building to get out rapidly in the event of an emergency or panic situation even though the building is locked, as at night when people are working late therein.

The entrance opening 22 may be large enough for a pair or more of doors 20 or only a single door as shown and when pairs of doors are provided they may also be interlocked when closed with an automatic astragal between the lock stiles of the doors as shown and described in U.S. Pat. No. 4,009,537, which patent is assigned to the same assignee as the present application.

The entrance opening 22 of the building is provided with a rectangular door frame comprising a pair of vertical, spaced apart side frame members or jambs 24 and 26 disposed adjacent opposite edges of the door and interconnected adjacent their lower ends by a threshold or tread 28 and adjacent their upper ends by a header or horizontal jamb 30. The door 20 is adapted to be hingedly supported from the door frame jamb 24 on a pair or more of hinges 32 so that the door will pivot outwardly in the building entrance about a vertical axis coaxially aligned with the hinge pins of the hinges.

The door 20 includes a pair of vertical stiles comprising a hinge or pivot stile 34 attached by the hinges 32 to the jamb 24 and an opposite, lock stile 36 adjacent the jamb 26. The doors are hinged to swing outwardly when opened to provide better egress from a building for the occupants thereof. The door stiles are preferably formed of hollow, aluminum extrusions and are structurally interconnected adjacent their upper ends by a horizontal, upper rail 38 and at their lower ends by a lower rail 40. The door is also provided with a rail structure at an intermediate, mid or waist level which includes an outside rail 42 of channel-shaped, cross-section having an outer face or web **42*a* and a pair of upper and lower horizontal flanges 42*b* and 42*c* along the upper and lower edges of the face. The respective rails and door stiles of the door form a pair of upper and lower, large rectangular openings for accommodating upper and lower glazing panels 44 and 46 which are mounted in the openings with elongated glass stops or glazing element 48. In general, the door 20** may be of the type shown in U.S. Pat. Nos. 3,888,046 and 4,009,537 which are incorporated herein by reference.

As described more fully in the aforementioned U.S. Patents, and in the copending U.S. Patent Application Ser. No. 938,641, filed Aug. 31, 1978 and assigned to the same Assignee as the present application, the hollow lock stile 36 of the door is provided with an upper, latching assembly 50 adjacent an upper end portion which includes a latch element movable into and out of locking engagement with a bolt or projection provided in the header 30 of the door frame. At the lower end portion, the hollow lock stile is provided with a lower, latch assembly 52 which includes a latch element movable into and out of locking engagement with a strike plate or opening provided in the threshold 28 of the door frame. When the latches of the respective upper and lower latch assemblies are engaged in latching position with the door frame, the door 20 is firmly locked in position and excellent security is provided.

Figure 8:
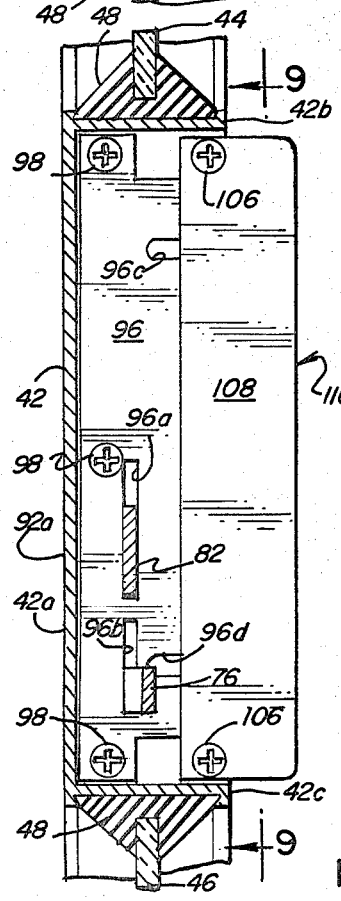
FIG. 8 is an enlarged, transverse, vertical cross-sectional view taken substantially along lines 8—8 of FIG. 1.
Figure 9:
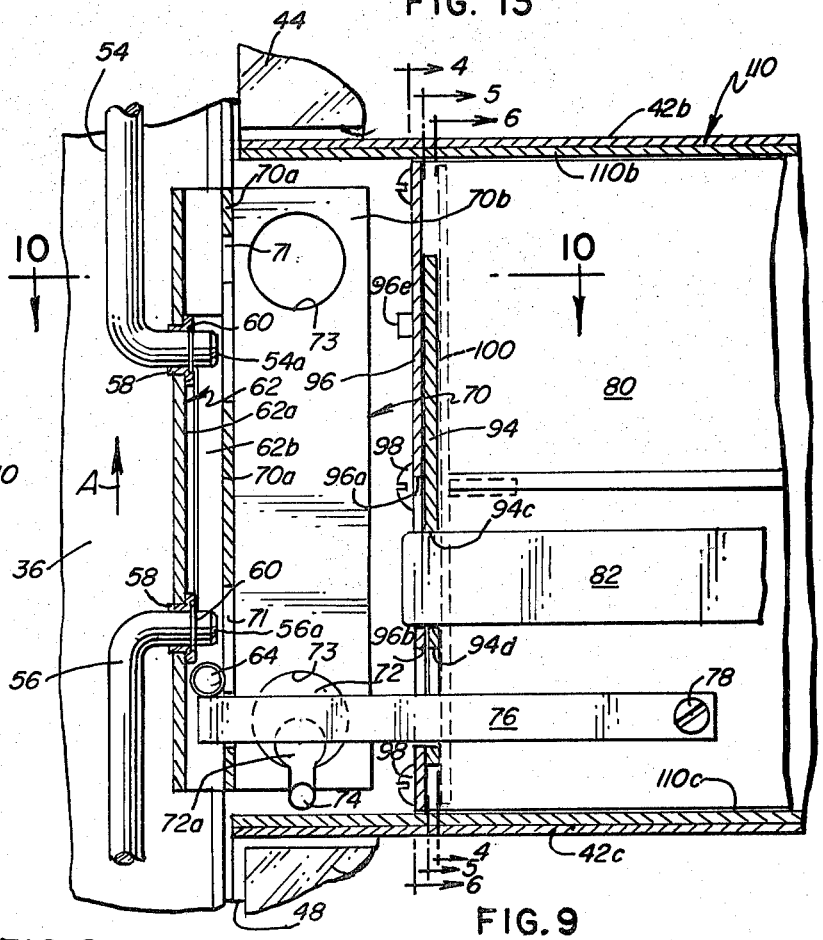
FIG. 9 is an enlarged, fragmentary, cross-sectional view taken substantially along lines 9—9 of FIG. 8.
Figure 10:
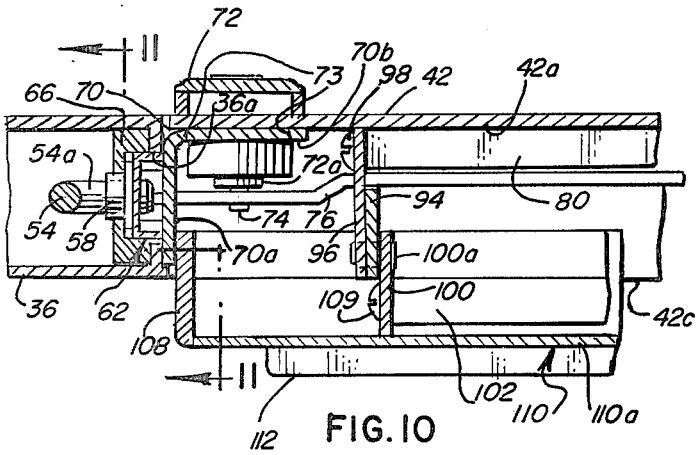
FIG. 10 is an enlarged, fragmentary, cross-sectional view taken substantially along lines 10—10 of FIG. 9.
Figure 11:
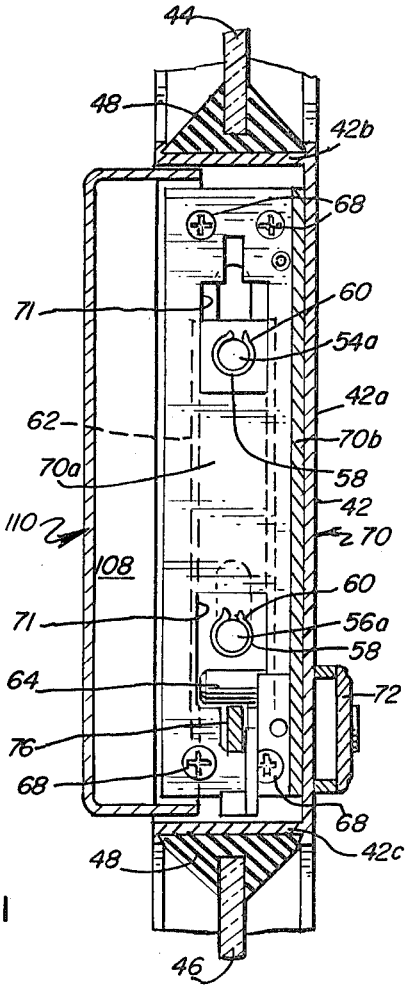
FIG. 11 is an enlarged, transverse, vertical cross-sectional view taken substantially along lines 11—11 of FIG. 10.

Actuation of the respective upper and lower latching assemblies 50 and 52 is achieved through a pair of upper and lower, elongated actuating rods 54 and 56 mounted for vertical movement within the hollow interior of the door stile 36 as best shown in FIGS. 8 and 10, and as described in the aforementioned patents. A detailed description of the structure and operation of the latching assemblies is provided in the aforementioned copending U.S. patent application and reference should be had thereto. At its lower end, the upper actuating rod is provided with a short, horizontal segment **54*a* which projects through a "Nylon" or plastic bushing 58 and which is keyed or secured to the bushing by a C-ring type washer 60. Similarly, at its upper end, the lower actuating rod 56 is provided with a short, horizontal leg 56*a* which projects through the opening in a similar bushing 58 also keyed or locked to the rod with another C-ring washer 60. The bushings 58 are mounted in a pair of vertically spaced openings formed in the web 62*a* of a channel-shaped slide or lift element 62 which is mounted for vertical sliding movement adjacent an inwardly facing edge wall of the tubular lock stile 36 as best shown in FIGS. 9 and 10**.

The channel-shaped element or lifter 62 includes a pair of side flanges **62*b* and a transverse lift roller 64 is mounted to extend between these opposite flanges at a level spaced below the short leg 56*a* of the lower actuating rod 56 as shown in FIG. 9**.

The slide or lifter 62 is mounted for vertical movement within a groove or way **36*a* in the inside transverse wall of the tubular stile 36 as best shown in FIG. 10 and a backing element 66 of channel-shaped cross-section is secured to the inside face of the grooved wall by means of threaded fasteners 68 which project through counter sunk openings formed in a transverse flange 70*a* of a steel lock angle 70. The lock angle is provided with a pair of generally keyholed shaped openings 71 spaced vertically apart in transverse flange 70*a* and also includes a flange 70*b* which abuts the inside surface of the face 42*a* of the intermediate rail member 42**.

The flange **70*b* of the lock angle 70 is adapted to bear against the inside face of the web 42*a* of the intermediate rail member 42 and this flange is provided with a pair of relatively large circular openings 73 adjacent the upper and lower ends as best illustrated in FIG. 9. A key operated lock assembly 72 is mounted in the lower opening and extends outwardly of the outer face 42*a* on the outside surface of the door 20 to permit the door to be locked and unlocked from outside with a key. The face 42*a* is drilled at the appropriate location to accommodate the lock which includes an eccentric inner arm 72*a* with an actuating pin 74 which is rotatable to raise and lower a lifter lever 76 when a key is utilized from the outside to unlock and lock the door. When the lock pin 74 is moved to rotate upwardly from the lowermost position as shown, the pin engages the underside of the lifter lever arm 76 and moves the outer free end upwardly. The free outer end of the arm extends through the opening 71 in the lower portion of the lock angle 70 and engages and lifts the underside of the transverse lift pin 64 on the lifter slide or channel 62. Thus, it will be appreciated that key operation of the lock 72 is available to move the lock pin 74 upwardly and lift the arm 76 thereby causing the channel slide 62 to move upwardly in the direction of arrow "A" (FIG. 9) and cause the bolts of the upper and lower latching assemblies 50 and 52** to be retracted to unlock or unlatch the door which may then swing freely open.

It should be noted that the lock angle 70 is symmetrical with respect to a horizontal center axis so that the angle may be utilized at either end of the intermediate rail member 42 for either left or right hand opening doors. It should also be noted that the lifter arm 76 may be positioned at either end adjacent the lock angle 70 depending on the swing direction of the door.

Figure 6:
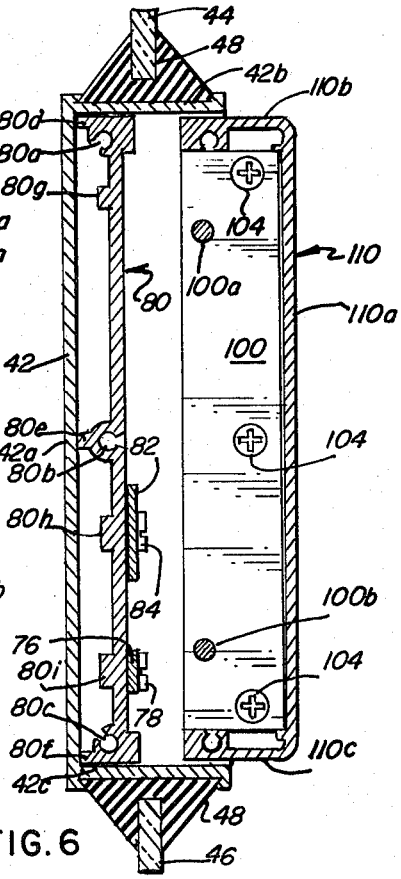
FIG. 6 is an enlarged, transverse, vertical cross-sectional view taken substantially along lines 6—6 of FIG. 9.
Figure 7:
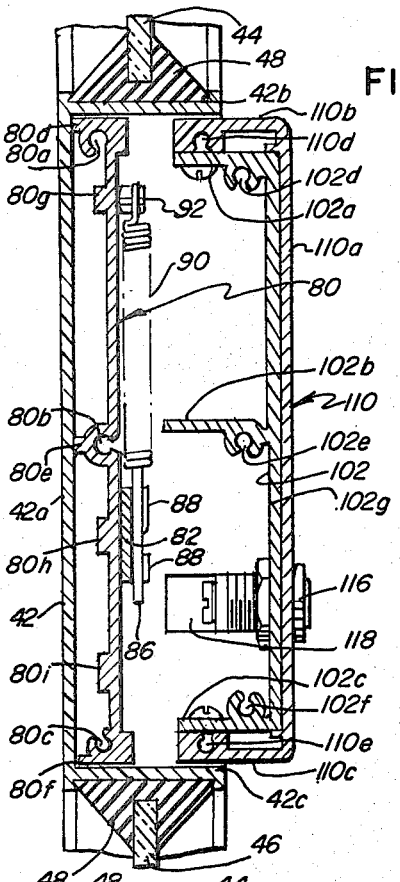
FIG. 7 is an enlarged, transverse, vertical cross-sectional view taken substantially along lines 7—7 of FIG. 2.

In accordance with the invention, the lifter arm 76 is pivotally secured by a pivot screw 78 to the vertical face of a rail chassis extrusion 80 which is nested and mounted inside the channel-shaped intermediate rail 42. The chassis provides a base for supporting many elements of the panic mechanism in accordance with the present invention, and as best illustrated in FIGS. 6 and 7, the chassis includes a plurality of vertically spaced, longitudinally extending screw splines **80*a*, 80*b* and 80*c*, disposed adjacent, respective horizontal spacer legs 80*d*, 80*e* and 80*f* which bear against the inside surface of the web 42*a*. In addition, the chassis 80 includes a plurality of longitudinally extending backing ribs 80*g*, 80*h* and 80*i* which provide stiffening for the planar web portion 42*a*** in areas of stress concentration adjacent the level of pivot pins and the like.

Figure 12:
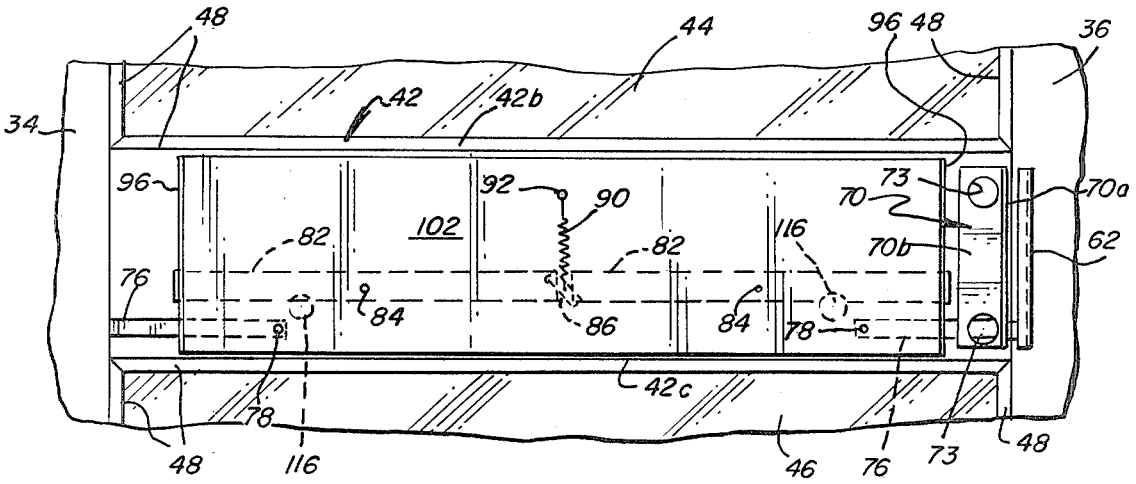
FIG. 12 is a vertical, cross-sectional view taken substantially along lines 12—12 of FIG. 3.
Figure 18:
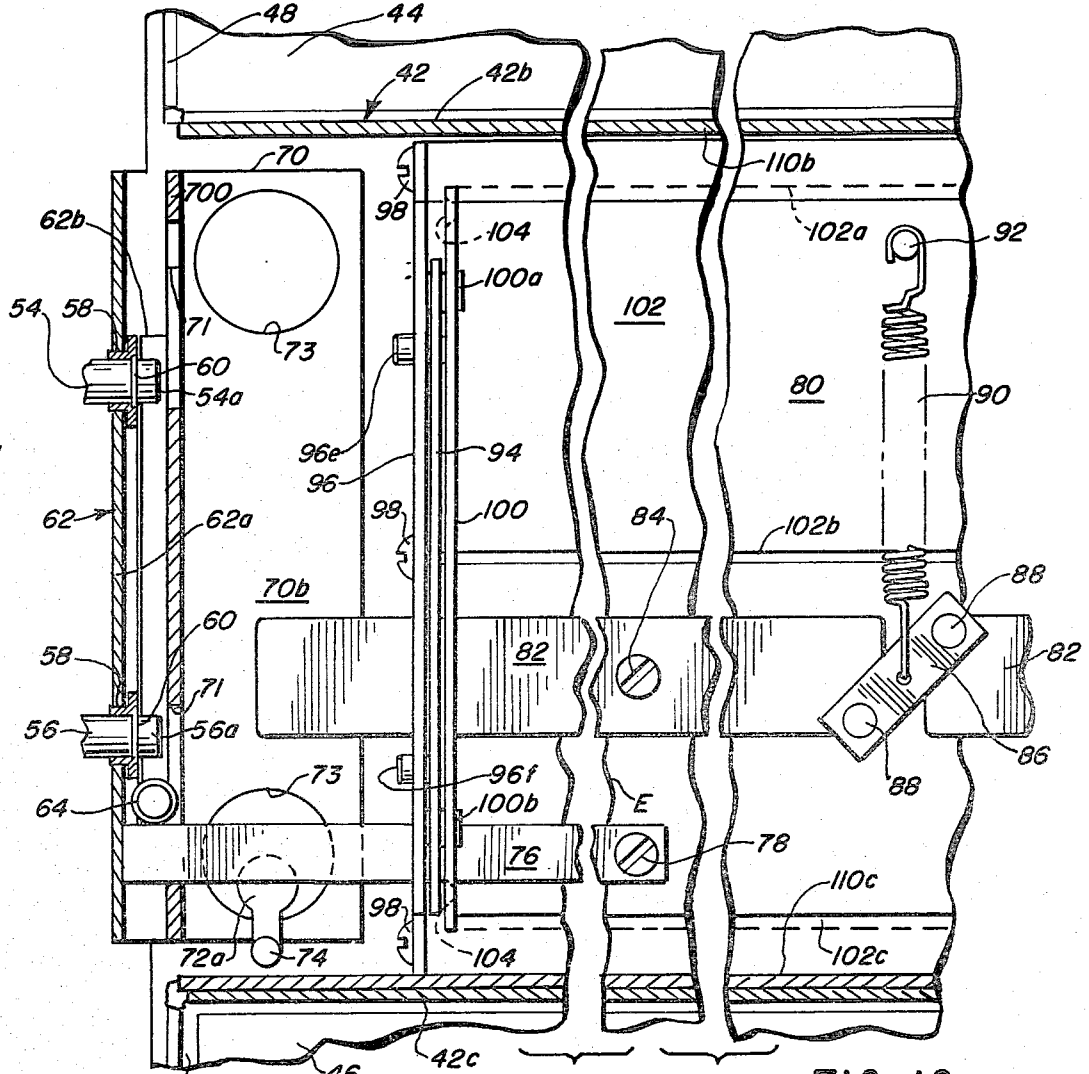
FIG. 18 is an enlarged fragmentary cross-sectional view similar to FIG. 17 but taken adjacent the lock stile end of the mid level rail of the door.

As illustrated in FIGS. 10 and 12, the chassis 80 is cut to be shorter in length than the cross-member 42 in order to provide an open space or distance between the end of the chassis and the adjacent vertical stiles of the door. This open space provides room for the installation of the lock angle 70 at either end of the chassis depending upon whether the door is of the left or right hand variety.

Figure 4:
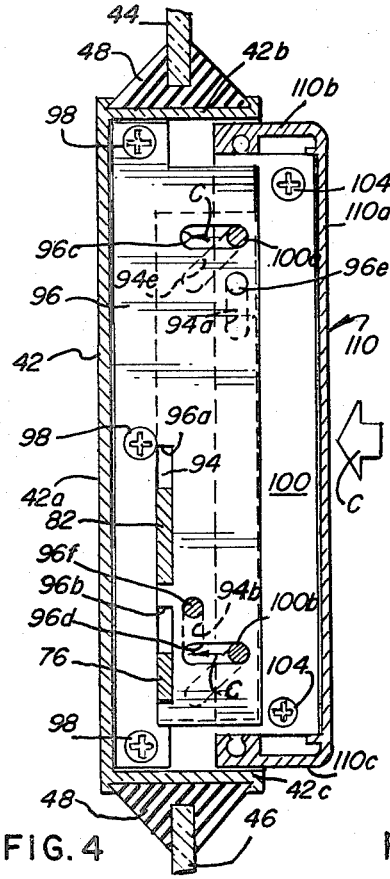
FIG. 4 is an enlarged, transverse, vertical cross-sectional view taken substantially along lines 4—4 of FIG. 9.
Figure 5:
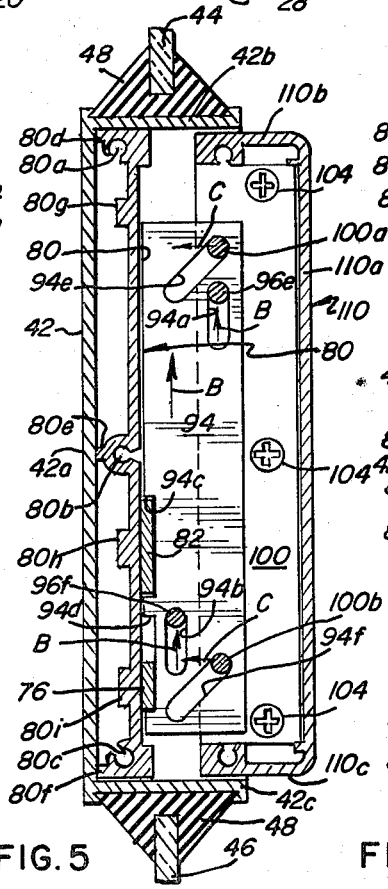
FIG. 5 is an enlarged, transverse, vertical cross-sectional view taken substantially along lines 5—5 of FIG. 9.

The chassis 80 also provides support for a pair of elongated lever arms 82 secured thereto on pivot screws 84 intermediate the ends of each arm at about a mid point thereon as shown in FIG. 12. The outer ends of the arms 82 extend outwardly beyond the ends of the chassis 80 and are spaced at a level above the outer end of the lifter arm 76 as shown in FIGS. 4, 5 and 6.

At the inner end of each arm 82 adjacent a mid portion of the chassis, the respective arms are pivotally interconnected by a linking element 86 and a pair of pivot pins 88 at opposite ends which pass through holes provided in the arms. The linking element 86 is connected to the lower end of a coil spring 90 having its upper end secured to the chassis adjacent the level of the upper rib 80g by means of a support pin 92.

Figure 13:
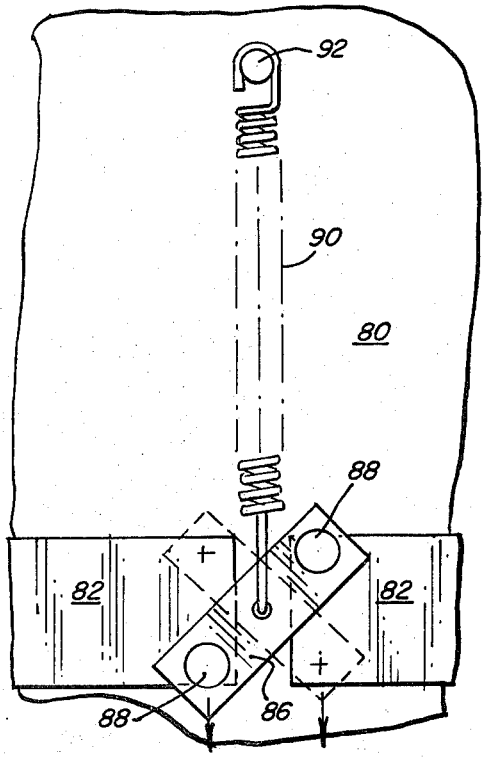
FIG. 13 is an enlarged, fragmentary, elevational view taken adjacent a middle portion of FIG. 12.

Referring to FIGS. 12 and 13, when the left hand lever arm 82 is pivoted about its mid point support pivot 84 in a clockwise direction, the right hand end is movable downwardly and this action elongates the bias spring 90. The left hand end of the right hand lever arm 82 is moved downwardly and the arm pivots about its support pin 84 in a counterclockwise direction. Thus, if the outer end of one lever arm is moved upwardly, interconnecting link 86 insures that the outer end of the opposite lever arm also moves upwardly and vice versa. The converse is also true in that downward movement of the outer end of one arm causes a similar downward movement of the outer end of the opposite arm. During arm movements, the pivot link 86 may rotate between the position shown in solid lines to the one shown in dotted lines and after arm movement has stopped, the bias spring 90 will normally return the inner ends of the arms 82 to a neutral position as shown.

The outer end of one of the elongated arms 82 is interconnected to elevate an adjacent lifter arm 76 by means of a vertical lift slide 94 which is sandwiched between a chassis end plate 96 and actuator panel end plate 100. The end plate 96 is secured to the end of the chassis 80 by a plurality of screws 98 extending into the screw splines 80*a*, 80*b* and 80*c* (FIG. 4) and the end plate 100 is secured to the end of a chassis extrusion 102 (FIG. 7) which is mounted in the interior of an elongated relatively wide actuator panel 110 formed of channel-shaped cross-section and nested within the upper and lower flanges of intermediate door rail 42.

The panel is mounted for horizontal movement on the door with an outer face 110a continuously maintained in precise controlled parallelism with the face 42*a* of the rail 42 and the door generally. The actuator panel is movable inwardly and outwardly relative to the door itself on a horizontal axis extending normal to the door face and is positively restrained against relative movement in other directions. With the door mounted to open outwardly, outward pressure on the panel by occupants inside the building is effective to unlatch the door to provide rapid exit from the building. It will thus be seen that outward pressure on the door in general from inside of the building results in relative inward movement of the actuator panel on the door toward a latch releasing position.

As illustrated in FIGS. 9, 10 and 12, the chassis 102 is somewhat shorter in length than the overall width of the panel 110 which extends almost all the distance between the stiles 24 and 26 in the embodiment of FIGS. 1–13. The chassis is provided with a plurality of inwardly extending horizontal flanges 102*a*, 102*b* and 102*c* and associated screw splines 102*d*, 102*e* and 102*f* for receiving threaded shanks of mounting screws 104 used for securing the end plates 100 to the opposite ends of the chassis 102 spaced inwardly of the ends of the panel itself. The chassis also includes a web or outer face 102*g* (FIG. 7) which abuts the inside surface of a planar web or outer face 110*a* of the panel.

As indicated, the panel 110 is of channel-shaped, cross-section and is nested for horizontal, parallel movement within the intermediate door rail 42 between the upper and lower flanges 42*b* and 42*c*. The actuator panel includes an upper flange 110*b* and a lower flange 110*c* with screw splines 110*d* and 110*e* associated therewith (FIG. 7) adapted to receive screw fasteners 106 used for attachment of a pair of panel end plates 108 provided at opposite ends of the panel closely adjacent the stiles 24 and 26 of the door.

As illustrated in FIG. 2, the outer surface 110a of the actuator panel extends substantially the entire distance between the stiles 24 and 26 of the door and affords a large area for persons to exert outward pressure against in order to open the door outwardly of the building in a panic or emergency situation. In addition, the outer surface of the panel web 110*a* may be provided with an appropriate pad 112 marked with the word "PUSH" to advise persons inside the building of the means for opening the door in a panic situation.

Even though the "PUSH" pad 112 is located to indicate the point at which the door may be pushed to open most easily and occupies only a fractional portion of the total surface of the web 110*a* of the panel, the pressure exerted outwardly from inside the building on any portion of the panel will cause the panel as a whole, and the door to swing open, and in relative terms the panel is depressed inwardly horizontal on the door body with the web 110*a* maintained in exact parallelism with the face of the door and the door frame rail 42. At the same time, this movement of the actuator panel causes the outer end portions of the elongated arms 82 to lift upwardly and in turn causes the outer end of the single lift lever 76 to move upwardly and thereby unlock the upper and lower latching assemblies 50 and 52 so that the door 20 will be released to swing open freely.

In order to provide and maintain the desired parallelism between the actuator panel 110 and the intermediate rail 42 even though the point of pressure appliation may be eccentrically applied on the surface 110*a*, a specially designed supporting interconnection mechanism is provided between each opposite end portion of the panel and the adjacent supporting portion of the rail 42. The chassis end plates 96 are provided with an upper vertical slot 96*a* spaced above and aligned with a lower slot 96*b* (as best shown in FIGS. 4 and 8), and the upper slots accommodate the outer end portion of the elongated arms 82. These slots 96*a* are substantially greater in vertical height than the width of the arms (FIG. 4) in order to permit upward travel of the arms when pivoted about their mid point on the pivot support pins 84 as previously described. The lower vertical slots 96*a* are adapted to accommodate a lift lever 76 which projects outwardly toward the slide channel 62. These slots have a height somewhat greater than the vertical dimension of the lever arm 76 in order to provide for pivotal movement of the lift arm. The end plates 96 are also formed with a pair of horizontally extending slots 96*c* and 96*d* spaced at upper and lower levels, respectively, and these slots are adapted to accommodate upper and lower guide pins 100*a* and 100*b*, respectively, secured to the inner end plates 100 of the crash panel 110. This pin and slot engagement insures that the relative movement of the panel 110 with respect to the rail 42 is always horizontal.

The chassis end plates 96 provide support for pairs of upper and lower vertically spaced, inwardly extending guide pins 96*e* and 96*f*, respectively, which are staggered or offset horizontally from one another (FIGS. 4 and 5) and which are disposed within a pair of vertical slots 94*a* and 94*b*, respectively, provided in the lift slides 94 mounted between the adjacent end plates 96 and 100 at each end of the panel 110. The lift slides 94 are provided with pairs of vertically spaced apart edge notches 94*c* and 94*d*, respectively, along their inner edge for accommodating the pair of elongated walking beams or lever arms 82 and the single lift lever 76. As best shown in FIG. 5, the notch 94*c* is just slightly larger in vertical dimension than the vertical width of an arm 82 so that the arm and slide move in substantial unison with each other without binding. However, the lower notch 94*d* is somewhat larger in vertical dimension than the vertical width of the lift lever 76 and this provides a lost motion interconnection between the arms 82 and the lift lever 76. When the arms 82 are pivoted so that the outer end portions move upwardly, the slides 94 also move upwardly as indicated by the arrows "B" and this in turn causes the lift lever 76 to pivot upwardly and raise the channel slide 62 to unlock the latch assemblies 50 and 52 as previously described. However, when the key lock 72 is activated to raise only the lever arm 76, the relatively large vertical dimension of the lower notch 94d permits the lever 76 to pivot freely upwardly without elevating the slides 94 or arms 82 and accordingly, the lost motion interconnection permits the independent use of the key lock 72 to unlock the latch assemblies 50 and 52.

The lift slides 94 are also provided with a pair of upper and lower vertically spaced apart, sloping, elongated slots 94*e* and 94*f*, respectively, for accommodating the pins 100*a* and 100*b* mounted on the inside panel end plates 100. These pin and slot connections provide for vertically upward movement of the lift elements 94 (arrows "B") in response to horizontal inward movement of the panel 110 as indicated by the arrows "C". From the foregoing, it will be seen that pressure on the panel 110 at any point on the surface 110*a* in the direction of the arrow "C" must always result in a horizontal movement with the panel face always in parallel with respect to the face of the door or the web 42*a* of the intermediate rail 42 even though the pressure may be applied at various different points eccentrically positioned on the enlarged outer face 110a of the panel. The pin and slot connections between the panel end plates 100, the intermediate slides 94 and the chassis end plates 96 and the interconnected arms 82 insure that precise parallel movement between the panel and door face is maintained.

Depression of the panel elevates both lift elements 94 and this causes the outer end portion of the elongated arms 82 to move upwardly and in turn raise the lift lever 76 to raise the slide 62 and unlock the upper and lower latch assemblies 50 and 52.

After an emergency or panic situation has passed and/or the pressure on the actuator panel is withdrawn, the panel is automatically returned to the normal extended position by virtue of the bias spring 90 acting on the walking beams 82. Also, after the door 20 is again closed, the weight of the operating rods 54 and 56 will normally be effective to relatch the upper and lower latch assemblies 50 and 52.

Because the end portions of the panel 110 are interconnected with the adjacent end plates 96 which are secured to the chassis 80 mounted on the intermediate door rail 42 and because of the interconnecting elongated arms 82, movement of the panel is always retained in precise parallelism with the face of the door without binding, and this feature permits pressure applied at any location on the outer surface of the web 110a to result in unlocking of the upper and lower latch assemblies 50 and 52.

This precise parallelism in relative movement between the panel 110 and the face of the door is obtained and insured by a plurality of cooperative restraints acting between these respective members. A first degree of constraint includes the pins 100*a* and 100*b* acting within the horizontal slots 96*c* and 96*d* and this interaction prevents relative vertical movement, yet permits relative horizontal movement between the panel and the door. A second degree of constraint is achieved by the nested engagement between the end panels 100 and the chassis end elements 96, which arrangement prevents any lateral horizontal translation of the panel 110 toward or away from the opposite stiles 34 and 36. A third degree of constraint prevents any angular translation of the panel or edges of the door about a horizontal axis extending between the opposite edges of the door and this constraint is achieved by the pairs of upper and lower vertical slots 94*a* and 94*b* and the pairs of sloping slots 94*e* and 99*f* and the respective upper and lower pairs of pins 100*a* and 96*e* and 100*b* and 96*f*, respectively, slidably engaged in the slots. Finally, a fourth degree of constraint to prevent angular translation of the panel about a vertical axis intermediate the ends of the crash panels is achieved by the outer end portions of the pivotally mounted and interconnected walking beams or arms 82 and the vertical slots 94*c* provided in the slides 94 between each pair of elements 96 and 100.

Because of the novel design, the panic apparatus is not readily seen from outside the building even though relatively large glass panels 44 and 46 are provided in the door 20. In addition, there is no conveniently exposed handle or U'bar spaced away from the adjacent door face as in conventional type panic apparatus and thus, there is nothing available to permit a thief using a trip wire or other device to unlock the panic system. Also, the unique panel configuration including the nested flanges along the upper and lower edges and the opposite ends as described, precludes the possibility of a person's hand, finger or arm becoming pinched or caught between a portion of the actuator and the door surface, a situation which might occur in a panic situation with conventional, spaced from the door face, U-bar type panic devices.

During normal operation, the door 20 is opened from outside the building by a handle 114 and in order to permit the door to open and close freely if desired, such as during normal business hours, the panic actuator system is provided with a feature for dogging or locking out the panic function to permit the door to swing freely.

Referring to FIGS. 2, 7 and 12, the door is provided with a key operated, dogging lock 116 which is mounted in a pair of aligned drilled openings formed in the webs 110*a* and 102*g* of the panel 110 and the chassis 102, respectively. The dogging lock includes a bent steel cam plate 118 which is rotatable into a position engaging and supporting the underside of one of the elongated arms or walking beams 82 in elevated position when the panel 110 is depressed. The arm is thus retained with an outer end in an upward position to unlock the respective upper and lower latch assemblies 50 and 52 and the elevated arm is then maintained in a dogged, unlocked condition. The elevated slides 94 retain the latch assemblies 50 and 52 in an unlatched condition and the panic system is inoperative so that the door 20 is swingable freely to open and close in response to the traffic entering and leaving the building.

At the end of the day, the door is then closed and the dogging lock is key operated to return the elongated arm 82 to normal operation and permit the latch assemblies to return to their normally latched, operational positions thereby reinstating the normal panic or emergency feature.

Referring now to FIGS. 14–18 therein is illustrated another embodiment of a panic actuator system referred to in FIG. 14 generally by the reference numeral 20A. The panic actuator is generally similar in operation and construction that the latter embodiment is adapted for use as a standard size or modular component suitable for installation on entrance doors of several different widths. Accordingly, reference numerals will be the same for those components of both embodiments which are the same or similar, and only the differences between the first and second embodiment will be described herein in detail.

Figure 16:
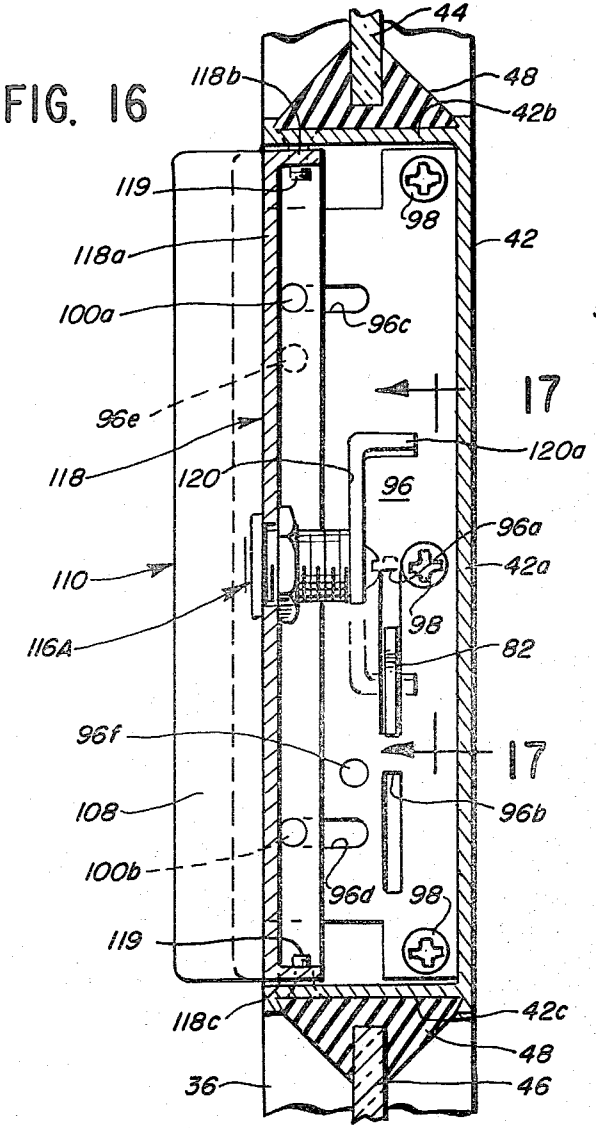
FIG. 16 is an enlarged fragmentary, transverse cross-sectional view taken substantially along lines 16—16 of FIG. 14.

The panic system is used as a standard size modular unit which can be fitted into doors ranging from a minimum size width of, for example 30" through several different larger sizes ranging up as high as 48" in width or more. In order to accommodate the different spacing distances between the door stiles 34 and 36 and a modular, or given size panel 110, an insert cover 118 of channel-shaped cross-section with an outer face 118a and a pair of upper and lower flanges **118*b* and 118*c*, respectively, is nested between the upper and lower flanges 42*b* and 42*c* of the intermediate door rail 42. The filler panel 118 is cut to horizontal length as required and is dimensioned with a horizontal distance sized to fit closely between the end plate 108 on the adjacent end of the modular size panel 110 and the inside edge of the adjacent pivot stile 34 of the door, as shown in FIGS. 14 and 15. The filler panel 118 is formed of an aluminum extrusion and is cut to any appropriate length for each different width of door usually from a relatively long piece of extruded metal. The cut panel is secured in place by countersink head, cap screws 119 extending through the respective flanges 42*b* and 42*c* of the intermediate rail 42 as shown in FIG. 16. A standard length modular, panel 110, for example 20" long, may be used with a variety of doors having different widths (30", 32", 36", 42", 48", etc.). The filler panel extrusion 118** is then cut to length to accommodate the particular width of the door in which a panic actuator panel is being installed.

In accordance with the invention, a modified lock out or dogging element 116A is provided with the modular or standard size panic system 20A. This dogging lock is key operated and is mounted in an opening provided in the web **118*a* of the filler panel. Accordingly, the lock 116A does not move inwardly and outwardly with the crash panel 110 as does the lock 116 in the previous embodiment. The dogging lock includes an L-shaped cam 120 which is secured on the inner end of the lock cylinder by a screw 122 and this arm is rotated between an upstanding and a downwardly depending position (as shown in dotted lines in FIG. 17) when a key is inserted into the lock and turned. When the arm 120 is in the upstanding position as shown in solid lines, a short cam portion 120*a* at the outer end is spaced well above and out of engagement with the outer end of the adjacent walking beam or arm 82. When it is desired to lock out or dog the panic system, the actuator panel 110 is depressed and this causes the arms 82 to be elevated at their outer ends as shown in dotted lines in FIG. 17. The key operated dogging lock 116A is then actuated and the cam 120 is rotated downwardly in a clockwise direction as shown by the arrow "D" until the cam portion 120*a* is brought into supporting contact under the lower edge of the outer end portion of one arm 82. In the lower position, the cam portion 120*a* maintains the arms 82 and the lift lever 76 at the opposite end of the panel in an upper position and this action effectively retains the upper and lower latch assemblies 50 and 52, respectively, in the unlatched position so that the door may swing freely to open and close in response to normal, daytime traffic. At the end of the normal working hours when it is desired to return the panic system into operation, the door is closed and the key is again inserted, this time to release the dogging lock 116A and return the cam 120** to the upstanding position, thus re-activating the normal panic function.

As previously described, the actuator panel may be used with either a left or right hand swinging door and the filler panel 118 is positioned to the left or right of the actuator panel 110 as the case may be. The key operated dogging lock 116A is mounted on the filler panel 118 rather than the movable panel 110 and is easily utilized. The key lock does not normally project outwardly beyond the outside surface 110a of the actuator panel 110.

The modular, standard size panel system of the embodiment of FIGS. 14–18 thus provides a panel actuator system for a door which can be used with a variety of doors of different widths and the only changes required for different sizes of doors is the cutting of a filler panel 118 to the desired length.

Although the present invention has been described with reference to several illustrated embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. In combination a door with a panic actuator apparatus for unlatching said door mounted in and normally maintained in latched engagement with a door frame, said door including a pair of separate stiles along opposite edges and latch actuating means movable for retracting latch means which is normally providing said latched engagement between the door and the door frame, said apparatus comprising:

housing means for said panic actuator comprising a rail of said door extending between and connected to said stiles at opposite ends between opposite faces of said door, said housing including an enlarged opening on one face of said door, an actuator panel mounted in said enlarged opening for relative movement on said door in response to external pressure applied at any point against a relatively large outer face of said panel;

means supporting said panel from said housing for movement along a linear axis normal to said one face of the door including a pair of slides mounted for vertical movement adjacent opposite ends of said panel, means interconnecting said panel and said latch actuating means for unlatching said latch means in response to said movement of said panel on said door, and said interconnecting means including a lever pivoted by the movement of one of said slides for unlatching said latch means.

2. The panic apparatus of claim 1 wherein said guiding means includes limit means for preventing relative vertical translation between said panel and said door during said relative movement.

3. The panic apparatus of claim 1 wherein said guiding means includes limit means for preventing relative horizontal translation between said panel and said door edges during said relative movement.

4. The panic apparatus of claim 1 wherein said guiding means includes limit means for preventing angular rotation of said panel about a horizontal axis during said relative movement.

5. The panic apparatus of claim 1 wherein said guiding means includes limit means for preventing angular rotation of said panel about a vertical axis during said relative movement.

6. The panic apparatus of claim 1 wherein said outer face of said panel extends for a substantial portion of the distance between said door edges.

7. The panic apparatus of claim 6 including a fixed face member parallel of said outer face of said panel extending between an end of said panel and an adjacent door edge.

8. The panic apparatus of claim 7 including key operated dogging means mounted on said fixed face for maintaining said panel in a depressed position on said door to retain said latch means in an unlatched condition permitting said door to swing freely open.

9. The panic apparatus of claim 7 suitable for doors of different widths wherein said panel is constructed with a standard width and is positioned with one end closely adjacent one of said door edges and wherein said fixed face member is cut to a width to fill the space between an opposite end of said panel and an opposite door edge.

10. The panic apparatus of claim 1 including key operated dogging means mounted on said panel face for maintaining said panel in a depressed position on said door to retain said latch means in an unlatched condition permitting said door to swing freely open.

11. The panic apparatus of claim 1 wherein said guiding means includes limit means for preventing relative angular movement about a vertical axis during said relative movement.

12. The panic apparatus of claim 11 wherein said limit means includes lever means pivotally mounted on said rail and interconnected to move said slides at opposite ends of said panel during said relative movement of said panel.

13. The panic apparatus of claim 11 wherein said lever means includes a pair of elongated arms having outer end portions connected to move said slides and inner ends pivotally interconnected.

14. The panic apparatus of claim 13 including bias means acting on at least one of said arms for urging said slides in a direction permitting return of said panel away from said depressed position.

15. The panic apparatus of claim 13 wherein said arms are mounted for pivotal movement about horizontally spaced apart axes wherein movement of one slide in one direction causes parallel movement of the other slide in the same direction.

16. The panic apparatus of claim 1 including key operated lock means on said door operable to pivot said lever for unlatching said latch means.

17. The panic apparatus of claim 16 including lost motion connecting means between said lever and said one slide whereby pivotal movement of said lever with said lock means does not result in movement of said one slide.

18. The panic apparatus of claim 1 wherein said guiding means includes a pair of members interconnected with each of said slides, one or said members in a pair secured to said panel and the other of said member in a pair secured with said door.

19. The panic apparatus of claim 18 including pin and slot connector means between each pair of said members and an associated slide wherein said relative movement of said panel on said door results in vertical movement of said slides.

20. The panic apparatus of claim 19 wherein said slides are limited against relative horizontal movement with respect to one of said panel and said door and are limited against relative vertical movement with respect to the other of said panel and said door.

21. The panic apparatus of claim 1 including a lost motion interconnecting means between said lever and said one slide wherein pivoting of said lever in one direction is ineffective to move said slide and movement of said slide in one direction is effective to pivot said lever in said one direction.

22. The panic apparatus of claim 1 wherein said panel is of channel shaped vertical transverse cross-section with adjacent upper and lower flanges nested for movement relative to door surfaces closely adjacent thereto.

23. The panic apparatus of claim 22 wherein the upper and lower flanges of said panel are nested inside the respective upper and lower flanges on a rail of said door.

24. The panic apparatus of claim 22 wherein said panel includes opposite vertical end surfaces nested for movement relative to closely adjacent surfaces of said door.

25. The panic actuator of claim 22 wherein said housing means is of channel shaped cross-section and includes a wall parallel of said one door face and a pair of flanges along opposite edges in parallel relation with said flanges of said panel nested closely adjacent thereto.

26. The panic actuator of claim 25 wherein said wall includes an outer surface flush with said face of said door opposite said one face.

27. The panic actuator of claim 1 wherein said outer face of said panel is spaced outwardly of said one face of said door and is movable inwardly toward said one face for unlatching said latch means.

28. The panic actuator of claim 27 wherein said outer face of said panel is parallel of said one face of said door.

29. The panic actuator of claim 28 wherein said supporting means includes means for maintaining said outer panel face in continuing parallel relation with said one door face during said inward movement for unlatching said latch means.

30. The panic actuator of claim 28 wherein said supporting means includes means for maintaining said outer panel face in parallel with said door face at least along one axis lying on said outer face during said inward movement for unlatching said latch means.

* * * * *